US007003386B1

(12) United States Patent
Ericsson et al.

(10) Patent No.: US 7,003,386 B1
(45) Date of Patent: Feb. 21, 2006

(54) DEVICE AND METHOD FOR DETERMINING THE POSITION OF A WORKING PART

(75) Inventors: Lars Ericsson, Täby (SE); Mikael Hertzman, Sollentuna (SE)

(73) Assignee: Trimble AB (SE)

( * ) Notice: Subject to any disclaimer, the term of this patent is extended or adjusted under 35 U.S.C. 154(b) by 0 days.

(21) Appl. No.: 09/341,101

(22) PCT Filed: Nov. 27, 1998

(86) PCT No.: PCT/SE98/02167

§ 371 (c)(1),
(2), (4) Date: Aug. 18, 1999

(87) PCT Pub. No.: WO99/28565

PCT Pub. Date: Jun. 10, 1999

(30) Foreign Application Priority Data

Nov. 28, 1997 (SE) ..... 9704398

(51) Int. Cl.
*G06F 7/00* (2006.01)
*G06F 17/00* (2006.01)
*G01C 21/00* (2006.01)

(52) U.S. Cl. ..... 701/50; 701/200; 701/207; 701/208; 701/213; 701/215; 701/223; 340/988; 340/990; 340/995; 340/992; 172/321; 172/322; 73/178 R

(58) Field of Classification Search ..... 701/50, 701/200, 207, 208, 213, 215, 223; 73/178 R; 172/321, 222; 340/988, 990, 995, 992
See application file for complete search history.

(56) References Cited

U.S. PATENT DOCUMENTS 4,053,893 A * 10/1977 Boyer ..... 340/995
4,472,978 A * 9/1984 Levine et al. ..... 33/321
4,691,385 A * 9/1987 Tupman ..... 359/114
4,807,131 A 2/1989 Clegg
5,174,385 A * 12/1992 Shinbo et al. ..... 172/4.5
5,347,387 A * 9/1994 Rice ..... 250/203.2
5,359,889 A * 11/1994 Jircitano et al. ..... 73/178 R
5,404,661 A * 4/1995 Sahm et al. ..... 37/347

(Continued)

FOREIGN PATENT DOCUMENTS

EP 810419 A2 * 12/1997
WO WO 95/28524 10/1995
WO WO 95/34849 12/1995

*Primary Examiner*—William A. Cuchlinski, Jr.
*Assistant Examiner*—Olga Hernandez
(74) *Attorney, Agent, or Firm*—Dinsmore & Shohl LLP

(57) ABSTRACT

The invention relates to a device and to a method for determining the position for a working part of a tool on a working machine with a position-determining apparatus (2, 4, 5, 6; 2, 4a, 4b, 5, 6'; 31, 33, 49, 50, 51, 1',53). At least one detector equipment (4, 5, 6; 4a, 4b, 5, 6'; 31, 33; 49, 50, 51, 53) is placed at a defined place on the working machine (3; 52) in order to determine the position of this position in a fixed coordinate system. At least one positional relationship device (11) determines the positional relation of the working part in relation to the detector equipment in a machine-based coordinate system. A calculating device (20) calculates, with signals from the position-determining apparatus and the positional relationship device, the position of the working part in the fixed coordinate system. The position-determining apparatus comprises an inclination- and orientation-measuring device (5, 20; 4a, 4b, 20; 31, 20; 51, 20) so that the apparatus measures both the instantaneous position and orientation of said position of the working machine in the fixed coordinate system. The calculating device (20) converts the measuring result from the position-determining apparatus and the positional relationship device in order to give the instantaneous position and/or orientation of the working part in the fixed coordinate system.

29 Claims, 3 Drawing Sheets

Figure 1:
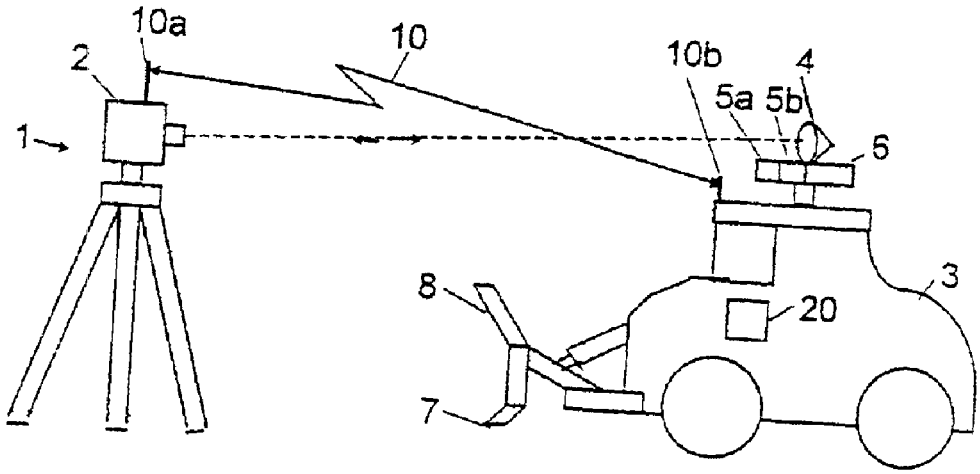

U.S. PATENT DOCUMENTS 5,416,976 A * 5/1995 Hane et al. ..... 33/324
5,572,809 A * 11/1996 Steenwyk et al. ..... 172/2
5,606,444 A * 2/1997 Johnson et al. ..... 359/152
5,612,864 A * 3/1997 Henderson ..... 700/59
5,682,311 A * 10/1997 Clark ..... 172/4.5
5,704,429 A * 1/1998 Lee et al. ..... 172/4.5
5,713,144 A * 2/1998 Haraoka ..... 172/4.5
5,719,500 A * 2/1998 Eschner et al. ..... 324/329
5,754,137 A * 5/1998 Durrstein ..... 348/120
5,764,511 A * 6/1998 Henderson ..... 172/4.5
5,771,978 A * 6/1998 Davidson et al. ..... 172/2
5,774,832 A * 6/1998 Vanderwerf ..... 701/220
5,798,733 A * 8/1998 Ethridge ..... 342/357.08
5,848,368 A * 12/1998 Allen et al. ..... 172/4.5
5,848,485 A * 12/1998 Anderson et al. ..... 356/141.1
5,875,854 A * 3/1999 Yamamoto et al. ..... 172/4.5
5,878,977 A * 3/1999 Hosaka et al. ..... 244/3.13
5,904,210 A * 5/1999 Stump et al. ..... 175/40
5,923,270 A * 7/1999 Sampo et al. ..... 180/6.7
5,928,309 A * 7/1999 Korver et al. ..... 342/359
5,953,838 A * 9/1999 Steenwyk ..... 172/2
5,974,675 A * 11/1999 Yamada et al. ..... 248/207
6,044,316 A * 3/2000 Mullins ..... 340/995
6,068,060 A * 5/2000 Ohtomo et al. ..... 172/4.5
6,095,254 A * 8/2000 Homburg ..... 172/5
6,112,145 A * 8/2000 Zachman ..... 701/50
6,145,378 A * 11/2000 McRobbie et al. ..... 166/254.1
6,154,699 A * 11/2000 Williams ..... 239/1
6,209,232 B1 * 4/2001 Ono et al. ..... 37/348
6,218,574 B1 * 4/2001 Liu et al. ..... 562/593
6,226,572 B1 * 5/2001 Tojima et al. ..... 340/988
6,246,932 B1 * 6/2001 Kageyama et al. ..... 340/992
6,246,938 B1 * 6/2001 Giletta et al. ..... 342/357.17
6,275,758 B1 * 8/2001 Phelps ..... 701/50
6,283,222 B1 * 9/2001 Gengler et al. ..... 172/2
6,304,210 B1 * 10/2001 Allison et al. ..... 342/357.08
6,324,455 B1 * 11/2001 Jackson ..... 342/457
6,351,310 B1 * 2/2002 Emge et al. ..... 356/460
6,364,028 B1 * 4/2002 Ferrell et al. ..... 172/1
6,374,147 B1 * 4/2002 Rockwood ..... 414/699
6,374,169 B1 * 4/2002 Demay et al. ..... 307/10.1
6,374,190 B1 * 4/2002 Schupfner ..... 702/149
6,377,881 B1 * 4/2002 Mullins ..... 172/2
6,389,345 B1 * 5/2002 Phelps ..... 701/50
6,389,785 B1 * 5/2002 Diekhans et al. ..... 172/4.5

* cited by examiner

DEVICE AND METHOD FOR DETERMINING THE POSITION OF A WORKING PART

The present invention relates generally to devices for determining the position of a working part of a tool on a working machine with a position-determining apparatus, and methods for determining the position of a working part of a tool on a working machine. The invention concerns particularly the controlling of an industrial machine, for example a ground-leveling machine, crane, dredger or the like.

BACKGROUND OF THE INVENTION

During road construction or the leveling of ground, for example for buildings, parks or playgrounds, vehicle displays or the like, ground preparation machines are used which are to give a predetermined topography to the place of ground through, on one hand digging and on the other hand piling up material.

It is important in this connection that the working tools on the machines that are used can be accurately controlled to the exact right working level in the intended section. The control should preferably even be able to be remote-controlled automatically so that the desired topography in the right position inside a section should be able to be written into a computer program and information concerning suitable processing should be able to be given continuously and automatically to the driver of the vehicle. It should also, in the cases where it is possible, be able to have automatic controlling of the machines in order to perform certain work completely automatically.

This implies that for ground-working equipment one needs to keep track of the exact position in space of the working tools' positions in space, the angular position in both horizontal and vertical directions and their working directions.

DESCRIPTION OF RELATED ART

U.S. Pat. No. 4,807,131 (Clegg Engineering) describes a ground preparing system with the use of an instrument with a horizontal plane-identifying rotating sweeping beam, and a height indicator placed on a ground-preparing machine, for hitting by the sweeping beam. The height indicator is placed directly onto the working tool of the machine, for example on the blade of an excavator. Furthermore, a separate position generator can be placed on the machine and cooperate with an electronic distance-measuring instrument in order to give the position of the machine in the region which is to be treated. The signals from the different above-mentioned indicators are fed to a computer, which is given information on the desired topography of the region of ground via predetermined, composite data, and which compiles measuring values and gives indication for controlling the working tool of the machine. This arrangement with the position sensor on the machine and the height sensor on the blade does not solve the problem of determining the position of the blade in a fixed coordinate system, which is also pointed out in U.S. Pat. No. 5,612,864 (Caterpillar Inc). According to said patent the problem is solved through two position sensors being placed on the blade, whereby the slope of the blade in one direction relative to the machine is measured with an angle sensor and the orientation of the machine is extrapolated out of the measuring data taken during movement of the machine.

Placing the position detectors on the blade, however, implies two large disadvantages:

A. The detector or detectors are sometimes obscured by the machine if they are not placed on high masts, which reduces the accuracy and reliability. The detector or detectors must, however, be able to cooperate with a measuring beam, no matter how the machine twists and turns during work.

B. The detector or detectors are extremely exposed to damage during working, dirt, vibrations, mechanical damage, etc.

To determine the orientation and inclination via machine movements is furthermore a slow method and it is not unambiguous if the machine can reverse or move side-ways. Likewise, position- and height-determination with the aid of GPS-technique or with electronic angular and distance measuring often is not sufficiently fast in order to be able to measure the position and, above all, the height with sufficient accuracy during fast displacements.

There are other types of systems which concern remote controlling of one or more machines in a working place with the help of several geodesic instruments. Each instrument can automatically focus on and follow a reflector and give information on distance and angular position to the reflector in both the vertical and horizontal directions. It is then intended that the ground-preparing machine receives position information from only one of the distance-measuring instruments. In this case it is intended to discriminate away the information from the others.

The international application WO95/34849 (Contractor Tools) describes such a system where there is a horizontal ring of reflectors and where it is possible to controllably use only the reflector which is directed towards the distance-measuring instrument which is to be used in each given moment. Only the coordinate position of the machine is measured.

The international application WO95/28524 (Caterpillar Inc.) shows the controlling of a number of ground-preparing machines, where the actual position of each machine is shown with the help of a position-giving arrangement, e.g. a GPS-receiver (GPS=Global Position System) placed on top of each machine. A base reference station is placed in the vicinity of the machines. Control and correction information for the machines is transmitted between the base reference station and the machines.

OBJECTS OF THE INVENTION

One object of the invention is to provide a control indication for a ground-preparing machine, which makes possible adequate control of the machine with so few as possible measuring units placed outside the machine.

Another object of the invention is to produce controlling of a ground-preparing machine, where that which is important is the indication of working position and working direction of the working part of the machine tools but where the influence of the vibrations of the working part, unfavorable environment, obscured positions etc. are removed.

A further object of the invention is to provide a direct position-determining and an automatic following of the working portion of the machine's working part during the working operation.

Yet another object of the invention is to provide great flexibility in the setting up of a measuring system in relation to the working machine in combination with large work regions, high accuracy and distance and/or close indicatable positioning.

A further object of the invention is to provide a flexible system which is usable for measuring of the instantaneous working position and the working direction for different types of working machines, e.g. ground-preparing machines, digging machines, cranes, etc.

Yet another object is to provide an instantaneous, continuous and correct position and direction indication of a ground-preparing machine during work, each during fast movements.

SUMMARY OF THE INVENTION

The above mentioned objects are obtained with a device which has the features stated in the characterizing part of claim 1. Further characteristics and developments are stated in the other claims. basic coordinate system. In order to achieve this without placing equipment on the working part, the position for a point on the machine (x,y,z) as well as the inclination of the machine ($f_x$ and $f_y$ in relation to the vertical) and its orientation around a vertical axis ($f_z$) in this fixed coordinate system must be determined. Furthermore, the position of the working part in relation to the position of the measured point in a local machine-based coordinate system must be known. This position is either fixed and known or also different methods can be used for determining the position relationship, which for example is based on sensors of e.g. the potentiometer or resolver type which are placed at the links which connect the tool to the machine. Such methods are known in the prior art and are not dealt with in this connection.

The invention includes a system with a position-determining apparatus comprising at least one detector equipment placed on a suitable position on the working machine in order to determine the position of this position in a fixed coordinate system, at least one position relationship device to determine the inclination and/or orientation of the machine (inclination and orientation are summarized in the following with the name "orientation") in the same fixed coordinate system and with an accelerometer device. The positional relationship of the working part in relation to the detector equipment in a machine-based coordinate system is known in the prior art. Furthermore, a calculation device, which with signals from the position-determining apparatus and positional relationship device determines the position of the working part in the fixed coordination system, is included. The device is also characterized in that the position-determining apparatus comprises an orientation-measuring device so that the apparatus measures instantaneously both position and orientation of said position on the working machine in the fixed coordinate system, and that the calculating device converts the measuring result from the position-determining apparatus and the positional relationship device in order to give the instantaneous position and orientation of the working part in the fixed coordinate system.

The position- and orientation-determining apparatus can comprise, on one hand, a relatively slow, accurate determining device, which at time intervals accurately measures the current position and orientation of the machine, and on the other hand a fast determining device, which reacts on position and/or orientation changes in order to calculate and update the calculation between said time intervals. This fast determination device in this case only has to be stable for short periods of time because a slow drift is corrected through update from the slower device.

The relatively slow, accurate position and orientation determination can take place with the help of a stationary measuring station, for example a geodesic instrument with automatic target-following or a radio navigation system, for example GPS (Global Positioning System) placed in the vicinity of the working machine for position-determining in cooperation with the detector device. The inclination can also be determined e.g. by inclinometers and the orientation around the vertical axis e.g. by compass or by a north-seeking gyro.

The short time-period-stable determining device can thereby comprise an accelerometer device on the machine for measuring the acceleration of the machine in at least one direction, preferably in several mutually different directions, whereby the calculation unit double-integrates the indicated acceleration or accelerations and updates the latest calculated result of the position in the fixed coordinate system.

When a quick determination of a change of orientation is needed, preferably a further accelerometer or a gyro is used for each axis around which rotation is to be determined. The signals from these sensors are used, after suitable integration and conversion from the coordinate system of the machine to a fixed coordinate system, to update the position-determinations for the machine in the fixed coordinate system. A suitable way of putting together the information from the slow and the fast sensors in an optimal manner is to use Kalmann filtering.

Preferably, measuring and calculation are continuously performed at intervals while the machine is in operation. The calculating unit calculates after each measuring the position, and possibly the direction of working and the speed of working, of the working part of the tool, using the latest and earlier calculation results for the position. The calculating unit can also use earlier calculation results in order to predict the probable placement, orientation, direction of working and speed, a certain time in advance for the working part of the working machine.

ADVANTAGES OF THE INVENTION

By the invention a measuring system has been produced which is easy to use and which furthermore is relatively cheap. Already existing stations for measuring a region can be used for controlling the working machines. This means that special equipment for the stations does not need to be brought or transported to the working place, especially for use with the invention.

As it is the position and orientation of the working machine itself which are measured, and as the position of the working part is then calculated with the help of signals from the positional relationship devices, a system is obtained which can use separate control and sensor systems of any type for the machine, especially concerning preparation machines and excavators. Sensitive rotation indicators on the vibration-working part itself can be avoided.

SHORT DESCRIPTION OF THE FIGURES

Figure 2:
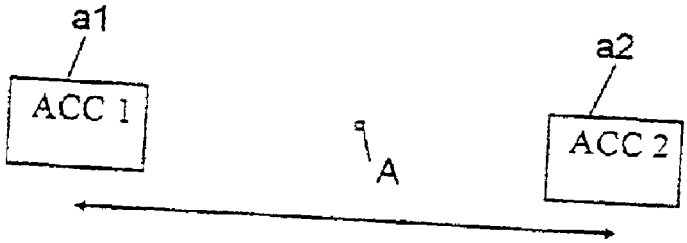
Figure 3:
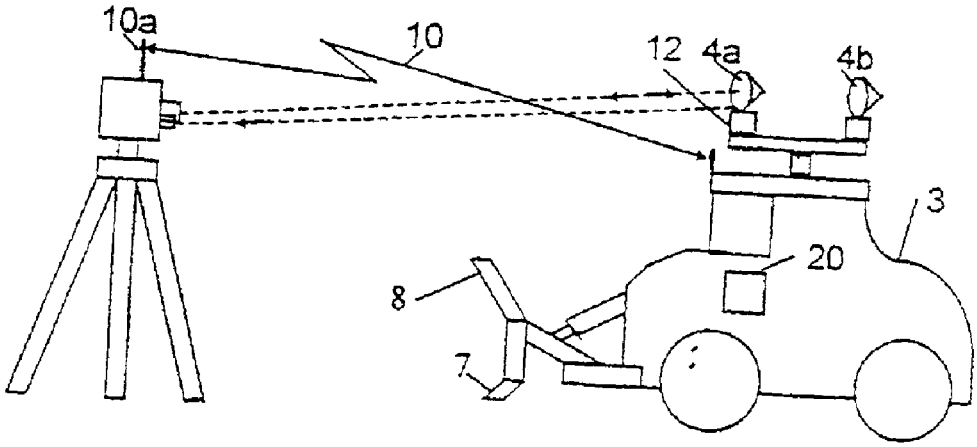
Figure 4:
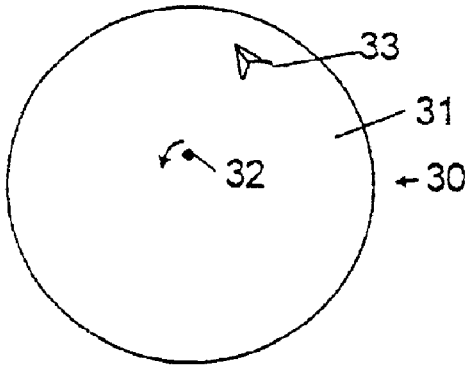
Figure 8:
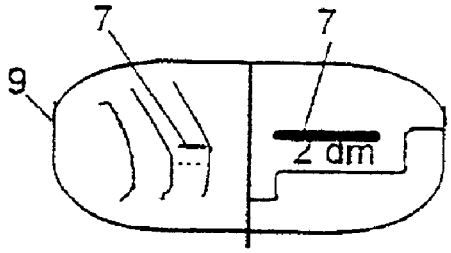
Figure 5A:
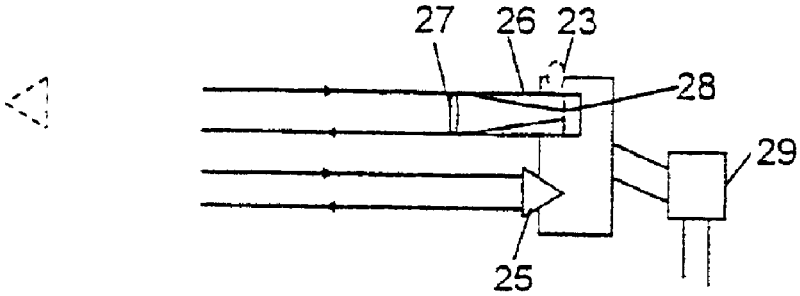
Figure 5B:
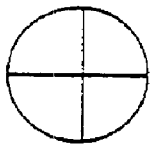
Figure 5C:
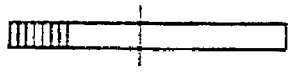
Figure 6:
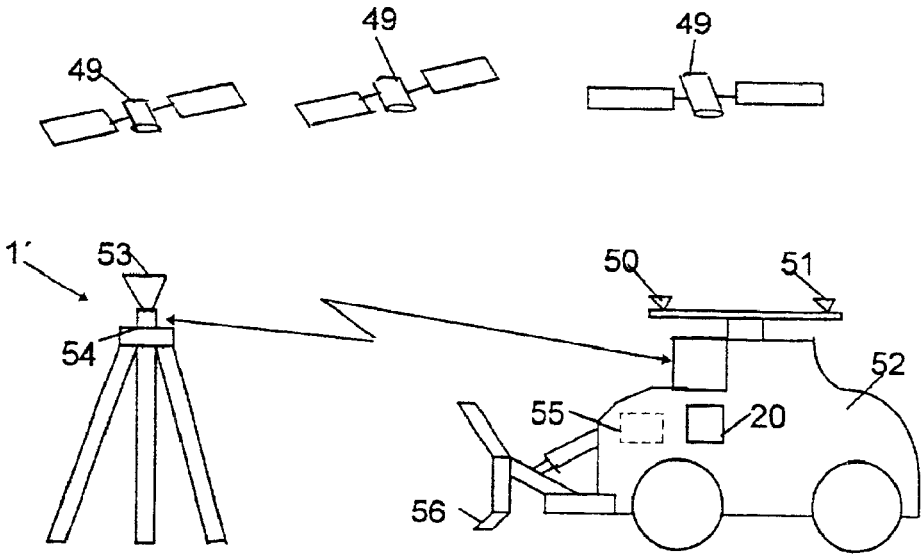
Figure 7:
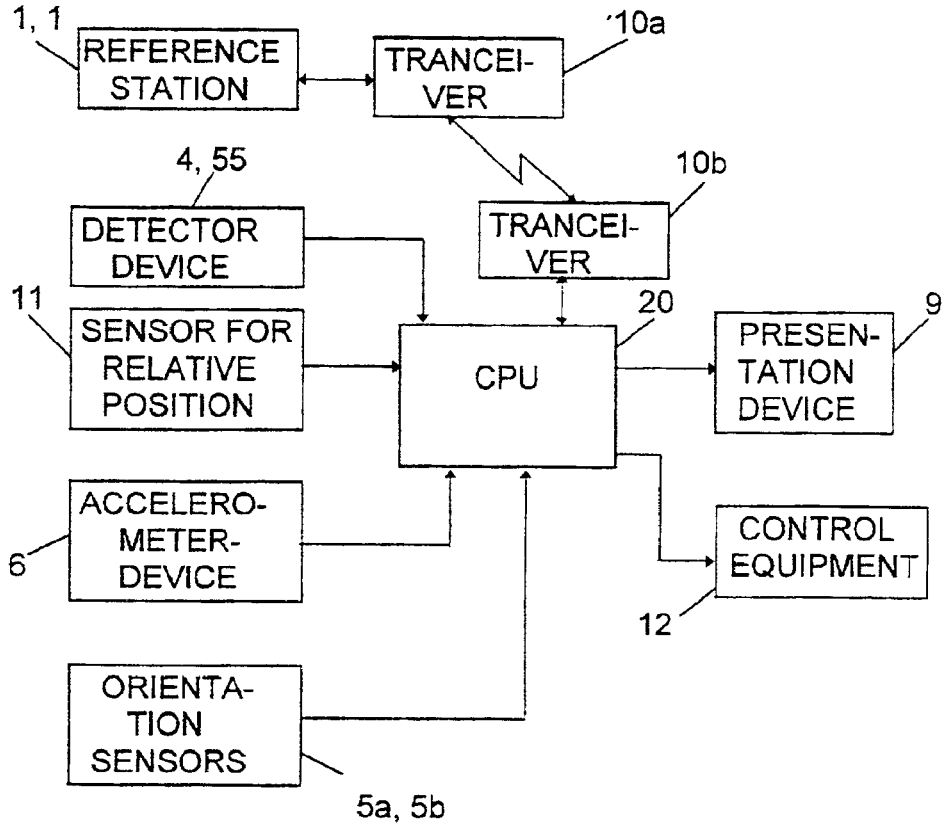

The invention is described more closely below with reference to the accompanying drawings, where FIG. 1 shows schematically an excavator with a first embodiment of a measuring system according to the invention, FIG. 2 shows a block diagram of an accelerometer device, FIG. 3 shows a second embodiment of a system according to the invention, FIG. 4 shows an embodiment of the position of a reflector on the excavator in FIG. 3, FIG. 5A shows an embodiment of a detector unit used in the measuring system according to the invention, FIG. 5B shows a first embodiment of a detector for the device in FIG. 5A, FIG. 5C shows a second embodiment of a detector for the device in FIG. 5A, FIG. 6 shows schematically an excavator with a third embodiment of a measuring system according to the invention, FIG. 7 shows a block diagram for a complete measuring system according to the invention, FIG. 8 shows a picture on a screen in the control cabin of the excavator.

DETAILED DESCRIPTION OF THE DIFFERENT EMBODIMENTS OF THE INVENTION

Embodiment 1

According to the embodiment shown in FIG. 1, a geodesic instrument I is set up on a ground area which is to be treated. The instrument 1 is, for example, an electronic distance-measuring instrument 2 with an integrated distance and angular measurement of the type which is called a total station and which is marketed by SPECTRA PRECISION AB, i.e. with combined advanced electronic and computer techniques. The position and the horizontal angular position of the instrument 1 is first measured in the common way well-known for the skilled man. This can, for example, be performed through measuring against points in the region with predetermined positions, e.g. church towers or the like.

A geodesic instrument gives both the distance as well as the vertical and horizontal direction towards a target, whereby the distance is measured against a reflector, e.g. of the corner cube type. A geodesic instrument is furthermore provided with a computer with writeable information for measurings to be performed and for storing of data obtained during the measurings. Preferably an unmanned geodesic instrument is used for the invention, which means that the instrument automatically searches and locks onto and follows an intended target, which can be made of the same reflector which is used for the distance measuring or some other active target as described later. The geodesic instrument calculates the position of a target in a fixed ground-based coordinate system.

A working machine in the form of a ground-preparing machine, e.g. a ground scraper machine, is, for the slower, accurate position measuring in this embodiment, provided with a reflector unit 4, e.g. a corner cube prism in a placement on the machine which is well visible from the geodesic instrument 1, no matter how the machine twists and turns, on the roof of the machine in this case, and with an orientation-determining unit 5*a*,5*b* and a device 6 comprising at least one accelerometer for acceleration-sensing and possibly a further accelerometer or a gyro unit for sensing rotation.

A corner cube prism reflects back an incident beam in the opposite direction even if the angle of incidence to its relatively oblique. It is important that the reflector unit 4 does not point a non-reflecting side towards the instrument 1. It should therefore preferably consist of a set of corner cube prism placed in a circle around an axis.

The orientation of the machine in a fixed coordinate system in this embodiment is determined by the units 5*a*,5*b*, which for example contain two inclination sensors 5*a* for determining the inclination towards a vertical axis in two perpendicular directions and an electronic compass or a north-seeking gyro 5*b* for determining the orientation in a fixed coordinate system, for example in relation to north.

It is important that the system can follow fast courses of events, as the machine during its work can tip if it rides up on a rock or down into a dip. A possibility for a short-term-stable, accurate and rapid determination of position and orientation changes in the machine-based coordinate system, for subsequent conversion to the fixed coordinate system, should therefore be provided. With such a possibility the position and direction changes can be determined in the interval between the slower position and orientation determination of the machine via the total station.

Therefore the accelerometer device 6 is placed on the machine for indicating rapid movements. This device 6 should preferably sense fast movements and rotation of the machine in different directions, in order to give satisfactory functioning. A minimum requirement is, however, that the device senses the acceleration along an axis of the machine, and in this case preferably its normal vertical axis (z-axis) because the requirement for accuracy normally is greatest in this direction, where the intention of the ground preparation normally is to provide a certain working level in the vertical direction. Preferably, however, the device 6 should sense acceleration and/or rotation in relation to three difference axes of the machine.

The acceleration measurers can be of any conventional type whatsoever and are not described and exemplified in more detail, because they are not part of the actual invention. Their output signals are double integrated with respect to time in order to give a position change. This can taken place in the unit 6 or in a computer unit 20 (see FIG. 8). The calculated position changes are given in the coordinate system of the machine but are converted then to the fixed coordinate system, so that the movements of the machine in the fixed coordinate system all the time are those which are continuously shown. These indications take place with such short intervals which are suitable for the control system used.

The geodesic instrument 1 can give absolute determination of the position of the reflector unit in the fixed coordinate system with a time interval of approximately 0.2–1 sec., wherein data from the device 6 supports the measuring system therebetween.

The ground-working part 7, i.e. the scraper part of the scraper blade 8 of the machine 3, is that which actually should be indicated in the fixed coordinate system with respect to position, rotation in horizontal and vertical directions and also preferably with respect to its direction of movement and speed of movement.

The machine's own positional relationship sensor (not shown) gives a basis for calculating the instantaneous position of the scraper part 7 in the coordinate system of the machine. Sensing and calculation of the instantaneous setting of the scraper blade in relation to the machine with geometric calculations are well-known arts and there do not need to be described more closely. The combination of information from the different sensors to a final position and orientation in the fixed coordinate system suitably takes place in the main computer 20. A suitable method for obtaining an optimal combination of the information from the different sensors for determining the actual position and orientation is the use of Kalmann filtering.

FIG. 2 shows schematically an accelerometer device 6 for sensing along an axis of the machine and with rotation-sensing around a perpendicular axis. In this way the accelerations $a_1$ and $a_2$ are sensed with the accelerometer ACC 1 and ACC2. By combining these two measured values and with knowledge of the distance d between the accelerometers, rotation and acceleration of some selected point (A) can be calculated. Through using three similar sets, the acceleration along and the rotation around three axes can naturally be determined. As an alternative or complement, the rotational changes around one or more axes can be determined with the help of gyros.

Embodiment 2

The ground-preparation machine 3 in FIG. 3 is, for the slow, accurate orientation determination around the vertical axis, in this embodiment provided with two reflector units 4*a* and 4*b* in a placement on the machine which is easily visible from the geodesic instrument 1. In the embodiment according to FIG. 3 they are placed with an essentially fixed placement in relation to each other and the machine. The possibility of having the reflectors movable between different "fixed" positions, in order to obtain a suitable orientation in relation to the measuring instrument, is obvious. Each of them should preferably consist of a set of corner cube prisms placed in circle around an axis.

The machine's three-dimensional placement and orientation in a fixed, or in relation to the measuring instrument defined coordinate system is measured through the measurement towards the reflector units 4*a* and 4*b,* which have a precise or determinable placement in the coordinate system of the machine. By determining the positions of the reflectors in the fixed coordinate system, then the orientation of the machine in this coordinate system can be determined, which means that the transformation between the coordinate systems is defined.

The reflector units 4*a* and 4*b* in FIG. 3 have each their own sighting indicator 12 and 13, which give direction information for the geodesic instrument as to the target or the reflector to which is instantaneous alignment should be made and for measuring against this target. The sighting indicator can be of different types; it is only important that it automatically aligns the geodesic instrument to the measuring reflector which for the moment is to serve as the target for the measurement.

The alignment indicators are, however, in the embodiment shown in FIG. 3, light elements, preferably provided with a special modulation and wavelength character which is separable from the environmental light, and are shown here placed under their respective target reflectors and preferably so that their light can be seen from all directions. The geodesic instrument 1 is thereby suitably provided, under the distance measurer 2 itself, with a seek and setting unit 14, which seeks a light signal, having the same modulation and wavelength character as the light elements. Each one of the alignment indicators 12 and 13 can suitably consist of several light elements arranged in a circle in the same way as the reflectors, in order to cover a large horizontal angle.

The light elements in 12 and 13 are lit alternatingly with each other in such a rate that the seek and setting unit 14 manages to set its alignment towards the light of the light elements, and measuring of distance and alignment to its associated targets is able to be performed. The measuring is performed in sequence towards the two reflector units 4*a* and 4*b*.

Alternatively, three (or more) reflector units with light elements can be placed in predetermined positions on the machine, whereby measuring towards these targets with calculations gives position, alignment and orientation of the machine in a three-dimensional fixed coordinate system.

FIG. 4 shows another embodiment of a target unit 30, towards which the geodesic instrument 1 can measure in order to obtain position data for the machine 3. The target unit comprises in this case a disc 31, which rotates around an axis 32 normal to the disc. A target, here in the form of a reflector 33, e.g. a ring of reflectors of the corner cube type, is mounted near the periphery of the disc 31. What is important with this embodiment is that the reflector 33 rotates around an axis 32, wherefore it instead can be mounted on a rotating arm (not shown). The detector unit 33 shaped as a reflector is consequently movable between positions with determinable positions in relation to the working machine, and an indicating unit, e.g., an encoder (not shown), continuously indicates the position.

A further alternative way of determining the orientation of the machine is to use a servo-controlled optical unit which automatically aligns with the geodesic instrument. With e.g. an encoder, the alignment of the optical unit can be read in the coordinate system of the machine. An embodiment thereof is shown in FIGS. 5A–5C. At least one servo-controlled optical unit 26–29 aligns itself with the geodesic instrument. In this case the optical unit is built together with the reflector, which gives the advantage that it can consist of a simple prism and not a circle of prisms. The units can, however, also be separated. For the optical unit it is appropriate to use the measuring beam of the geodesic instrument or a beam parallel with this.

In the embodiment shown in FIG. 5A the optical unit 26 is placed beside the reflector 25 shown in section. The optical unit consists of a lens or a lens system 27 and a position-sensitive detector 28. The lens/lens system focuses the measuring beam on the detector 28, which for example is a quadrant detector as is shown in FIG. 5B. The geodesic measuring beam of the instrument I can thereby be used also for the alignment device if the beam is sufficiently wide. Alternatively, and from the technical point of view, preferably, the instrument is, however, provided with an extra light source, e.g., a laser, which towards the unit 26–28 transmits a narrow light beam, which in this case can have a completely different character, for example another wavelength, than the measuring beam transmitted towards reflector 25, and is parallel with and arranged at the same distance from the measuring beam as the centre line of the tube 26 from the centre line of the reflector 25.

A third alternative is to place a corner cube prism for alignment of the reference station (not shown) and a light source 23 (drawn with dashed lines) up against the optical unit (26–28). In this case a reflected beam is obtained from the prism which is focused on the quadrant detector when the optical unit is correctly aligned to the station.

With the use of a quadrant detector 28 the servo-control can take place such that the subdetectors will have so similar illumination as possible. Such detectors are known in themselves, equally their use in different types of servo-control arrangements 29, and therefore are not described more closely.

The optical unit is movably and controllably mounted on the machine and possibly integrated with the reflector. Through the servo-control of the servo-motors (not shown) the optical unit is aligned so that the signals from the detector 28 are balanced, which means that the unit is orientated in the direction of the measuring beam. The alignment in relation to the working machine can be read, for example with some kind of encoder, or with some other type of sensing of the instantaneous setting positions of the guided servo-motors.

The above alignment can occur in both horizontal and vertical directions, but the complexity is reduced considerably if it is limited to guidance in the horizontal direction.

This is often sufficient when the inclination of the machine normally is minor in relation to the normal plane. In such a case the detecting can be performed with the help of a detector, elongated in the transverse direction, and a cylinder lens which collects the radiation within a certain vertical angular region to the detector. Because FIG. 5A shows a cross-section, it also corresponds with this embodiment. The detector can be made of, for example, a one-dimensional row of elements of e.g. CCD-type, as is shown in FIG. 5C.

Information on the direction from the geodesic instrument to the position detector, which is given by the geodesic instrument, together with the encoder reading which gives the orientation of the machine in relation to the geodesic instrument consequently gives the orientation of the machine in a fixed coordinate system.

The servo-control of the target reflector means that information is continuously received about the alignment of the vehicle in relation to the geodesic instrument 1.

Embodiment 3

In the above-described embodiments the position measuring has occurred through measuring against one or more targets on the measuring object from a geodesic instrument 1. Position-measuring can also occur with the help of radio navigation, e.g. GPS (Global Position System), by placing one or more radio navigation antennae on the measuring object and one on a stationary station to one side.

In the embodiment shown in FIG. 6 there is a radio navigation antenna 50, which here is shown receiving signals from a number of GPS-satellites 49, at the periphery of a rotating disc 51 on the upper part of an excavator 52. The position of the antenna is indicated in a radio navigation receiver 55 in at least two predetermined rotational positions of the disc 51 in relation to the excavator 52. The disc rotates so slowly that the antenna position in each rotational position can be indicated with accuracy but still so fast that normal movements of the excavator do not significantly influence the measuring result.

A reference station 1' with another radio navigation antenna 53 with receiver 54 is mounted on a station which is placed at a predetermined position outdoors with a known position somewhat to the side of the ground which is to be treated. A differential position determination is obtained through radio transfers between the radio navigation receiver 54 and the calculating unit 20 in the machine 52. The instantaneous position of the machine is calculated with so-called RTK-measuring (Real Time Kinematic). A calculation of this type is in itself well-known and does not need to be described more closely.

The only difference to earlier embodiments is that the position determination against the target(s) is made with GPS-technology instead of through measuring with a total station. For the rest, the orientation determination and determination of fast displacements and rotations takes place in the same way as described in earlier embodiments.

Common Block Diagram

FIG. 7 shows a block diagram according to the invention which is applicable to all the embodiments. It can be pointed out that with position determination with a geodesic instrument, position data for the target is collected in the reference station 1 and transmitted to the machine via radio link, while in the GPS-case it is correction data from the receiver 54 which is transferred from the reference station 1' to the machine and that position data is produced in the calculating unit 20 starting from data from the receivers 54 and 55.

The calculating unit 20 consequently calculates through combining data from the reference station 1 and, in the GPS-case, the receiver 55 together with data from the orientation sensors 5, accelerometer device 6 and sensors for relative position 11, the instantaneous position of the scraper blade in the fixed coordinate system, i.e. converted from the coordinate system of the machine. The sensors for relative position 11 can for example be encoders or potentiometer sensors connected to the links which join the working part of the machine. The calculating unit 20 is preferably placed in the machine.

The desired ground preparation in the fixed coordinate system is programmed into either the computer 20 of the geodesic instrument 1 or preferably of the machine 3. This is equipped with a presentation unit 9, preferably a screen, which presents to the operator of the machine (not shown), on one hand, how the machine 3 and its scraper blade 8 are to be maneuvered based on its instantaneous existing position and, on the other hand, its instantaneous deviation from the desired maneuvering. Alternatively and preferably an automatic guidance of the working part to the intended height and orientation is performed with the help of the control equipment 12 consisting of, for example, hydraulic maneuvering means which are controlled by the unit 20.

The machine operator must occasionally deviate from the closest working pattern because of obstacles of various types, such as stones or the like, which are not included in the geodesic instrument's programmed map of the desired structure of the ground preparation region.

It is also possible to show a programmed map of the desired preparation and of the existing position and direction of movement of the scraper part 7 on the map.

The information between the geodesic instrument 1 and the machine 3 can be sent wireless in both directions, as is shown by the zigzag connection 10. The computer in one or the other of these units can be chosen to be the main computer which performs the important calculations usable for the work of the machine 3 with the scraper blade, but preferably this is done in the unit 20. The most important here is that the calculation of the position and orientation of the scraper blade is performed in the fixed coordinate system, no matter where it is, that the geodesic instrument and electronic units in the machine have data-transferring connections with each other, and that the machine operator is given an easily understood presentation of what is to be done and what is finished.

FIG. 8 shows an example of a picture which can be presented to the machine operator on the presentation unit 9. A picture of scraper blade with an alignment mark is superimposed on a map with the desired profile of the ground preparation region, wherein the picture of the scraper blade moves over the map as working progresses. The presentation unit 9 can be split and can also show a profile picture with the scraper blade placed vertically over or under the desired ground level and with the height difference with respect to this being given.

The actual ground level does not need to be shown. However, it can be suitable to show parts of the ground with the desired height clearly in the picture to the machine operator so that he knows where to perform his work. In this case it is possible to have a function, which gives parts of the ground with a small difference within a predetermined tolerance level between the actual and the desired level, a predetermined colour e.g. green.

It is also possible, e.g. as shown with dashed lines in the map, to show a shadow picture of the scraper blade in order to indicate that it has not yet arrived at the right level. In this case it looks like the scraper blade is hovering over the ground and the machine operator obtains a clear indication of how deep the machine must scrape in order to get the shadow picture to unite with the picture of the scrape blade. It is suitable in the invention that the desired levels for the ground preparation which are shown on the map, wherefore it is the position of the shadow picture which indicates where the scraper blade 7 is in the normal to the plane of the map. In this connection it is of no interest to show the actual ground structure on the map.

Calculation of position and rotation of the machine both in vertical and horizontal direction is performed in the fixed coordinate system as well as subsequent calculation of the instantaneous position and rotation angles of the scraper blade after conversion from the coordinate system of the machine to the fixed coordinate system. Subsequently there follows a new sequence with the same measurements and calculations with subsequent calculation of the scraper blade's displacement from the previous measurement, whereby the direction and speed of the blade are obtained and presented on the presentation unit 9.

These measurement sequences are repeated during the machine's scraper work, whereby the machine operator the whole time during the working progress obtains instantaneous data concerning the scraper blade's position, alignment, direction of displacement and speed in the fixed coordinate system, and consequently obtains an extremely good idea of how the work is progressing compared to the desired ground preparation, and how the machine is to be maneuvered.

The geodesic instrument can only performed its alignments and measurements in a relatively slow speed in the fixed coordinate system. The accelerometer device is used in order to update the measuring results in the intermediate times. A special advantage of this updating function between the upgrades with the geodesic instrument is that, because the measurement towards the two measurement targets 4*a* and 4*b* in FIG. 3 cannot be performed simultaneously, it is possible, with the updating, to achieve that the delay between the sequential measurements towards the reflectors can be compensated for.

Through the machine's direction of displacement and speed being calculated continuously, it is also convenient to calculate a predicted position and orientation for both the machine and the working part a certain time in advance, based on earlier calculating data. How such calculations are performed with the help of the latest and earlier calculated data is obvious for the skilled person and is therefore not described more closely.

Many modifications of the embodiments shown are possible within the scope which is given by the accompanying claims. It is consequently possible to have mixed designs with both prisms and radio navigation antennae as position detector units. For example, the position and rotation alignment of a geodesic instrument can be determined with the help of one or more radio navigation antennae, for example one on the geodesic instrument and one at a distance from this. Other types of working machines than those shown, where on wants to have continuous information on position, angular position and direction of work during working progress, such as e.g. cranes, dredges or the like, are extremely suitable to be provided with the invention. Each stated calculation unit is suitably a computer or a subroutine in a computer, as is common nowadays.

What is claimed is:

1. A system for determining the position of a working part of a tool on a machine comprising:

a position-determining apparatus comprising at least one detector equipment placed generally at a designated place on the machine spaced away from the working part of the tool, the position-determining apparatus configured to provide data that corresponds to the position and orientation of the designated place on the machine in a fixed coordinate system;

at least one position relationship device configured to determine a positional relationship of the working part of the tool relative to the designated place on the machine in a machine-based coordinate system;

a calculating device resident on the machine configured to provide at least one of the position and the orientation and inclination of the working part of the tool in the fixed coordinate system based upon the position and orientation of the designated place on the machine in a fixed coordinate system and the positional relationship of the working part of the tool relative to the designated place on the machine in the machine-based coordinate system, wherein said calculating device uses earlier calculation results to calculate a probable position, orientation, direction of work and speed a certain time in advance for the working part of the tool.

2. The system according to claim 1 wherein:

the position-determining apparatus further comprises a stationary measuring station placed in the vicinity of the machine, the stationary measuring station operatively configured to determine the position of the machine in cooperation with the detector equipment; and the at least one detector equipment comprises at least two detector units placed at the designated place on the machine arranged in fixed positions relative to the machine, the at least two detectors arranged to cooperate with the stationary measuring station to give the orientation in space for the designated place on the machine.

3. The system according to claim 1, wherein:

the at least one detector equipment comprises at least one detector unit fixedly placed on the machine; and the position-determining apparatus further comprises an inclination- and orientation-measuring device including a north-seeking unit adapted to instantaneously sense the direction of the machine in relation to north.

4. The system according to claim 3, wherein the north-seeking unit comprises a select one of a north-seeking gyroscope and an electronically readable compass.

5. The system according to claim 1, wherein:

the position-determining apparatus further comprises a stationary measuring station placed in the vicinity of the machine, the stationary measuring station operatively configured to determine the position of the machine in cooperation with the detector equipment; and the at least one detector equipment comprises at least one movable detector unit movable between determinable positions in relation to the machine.

6. The system according to claim 5, characterized in that the at least one moveable detector unit is rotatable around an axis, the detector unit further configured such that measurement towards the detector unit is indicated when the detector unit reaches determined angular positions around the axis in relation to the machine.

7. The system according to claim 1, characterized by at least one totatably mounted and controllable optical unit placed on the machine that aligns towards a stationary measuring station such that the orientation of the optical unit relative to the machine is indicated and transmitted to the calculating device for determination of the orientation of the machine in the fixed coordinate system.

8. The system according to claim 7, wherein:

a select one optical unit is aligned towards the stationary measuring station at least in part using a chosen beam selected from the group consisting of the measuring beam of the stationary measuring station, a beam parallel with the measuring beam of the stationary measuring station, and a beam transmitted from the optical unit and reflected in a prism in the stationary measuring station.

9. The system according to claim 1, characterized in that each of the at least one detector equipment comprises at least one radio navigation antenna with a corresponding receiver.

10. The system according to claim 1, characterized in that the position- determining apparatus comprises a geodesic instrument with target-seeking function placed at a distance from the machine and measuring against at least one target on the machine.

11. The system according to claim 10, characterized in that each respective target is provided with an alignment indicator to provide alignment indications for the geodesic instrument concerning the respective target towards which instantaneous target-seeking is to be made and for measuring towards the respective target.

12. The system according to claim 1, characterized in that the calculating device comprises:

a stored map with a desired topography of an area which is to be treated:

calculated data for the working part of the tool configured to provide position and angular positions relative to the map; and a presentation unit configured to present the map and calculated data.

13. The system according to claim 1, characterized in that the position-determining apparatus comprises a relatively slow, accurate determining device which at time intervals accurately measures the actual position and orientation of the machine, and a relatively fast determining device which reacts on at least one of position and orientation differences to at least one earlier determination in order to calculate and update the determination between the said time intervals.

14. The system according to claim 13, characterized in that the relatively fast determining device comprises at least one accelerometer device on the machine adapted to measure the acceleration of the machine in at least one direction, and the calculating unit is further configured to integrate the indicated acceleration(s) and update the latest calculation result of the position of the working part of the tool in the fixed coordinate system.

15. The system according to claim 13, characterized in that the relatively fast determining device comprises at least one rotation-indicating device for rotation around at least one axis of the machine.

16. A method for determining the position of a working part of a tool on a machine comprising:

measuring both a position and an orientation of a designated place on the machine spaced away from the working part of the tool and in a fixed coordinate system;

determining a positional relationship of the working part of the tool relative to the designated place in a machine-based coordinate system; and calculating in the fixed coordinate system, at least one of an instantaneous position of the working part of the tool and an instantaneous orientation and inclination of the working part of the tool based upon the measured position and orientation of the designated place on the machine and the positional relationship of the working part of the tool relative to the designated place on the machine and, with the help of earlier calculation results, a probable position, orientation, working direction and speed a certain time in advance for the working part of the tool.

17. The method according to claim 16, wherein the act of measuring the position of the designated place on the machine comprises:

utilizing a stationary measuring station placed in the vicinity of the machine; and providing at least two detector units placed at the designated place on the machine arranged in fixed positions relative to the machine, said at least two detectors arranged to cooperate with the stationary measuring station to give the orientation in space for the designated place on the machine.

18. The method according to claim 16, further comprising fixedly placing at least one detector unit and a north-seeking unit on the machine for instantaneous sensing of the direction of the machine in relation to north.

19. The method according to claim 18, wherein the north-seeking unit comprises a select one of a north-seeking gyroscope and an electronically readable compass.

20. The method according to claim 16, wherein measuring the position of the designated place on the machine comprises:

utilizing a stationary measuring station placed in the vicinity of the machine, the stationary measuring station configured to cooperate with a detector device; and providing at least one movable detector unit movable between positions with determinable positions in relation to the designated place on the machine.

21. The method according to claim 20, further comprising:

rotating the detector unit around an axis placed at a distance therefrom; and measuring against the detector unit when the detector unit takes up determinable angular positions around the axis in relation to the working machine.

22. The method according to claim 16, further comprising:

rotatably mounting at least one controllable optical unit on the machine;

aligning the optical unit to a stationary measuring station;

indicating the orientation of the optical unit in relation to the machine; and calculating the orientation of the machine in the fixed coordinate system.

23. The method according to claim 16, characterized in that the measuring of both position and orientation is performed with the help of at least one radio navigation antenna with a corresponding receiver.

24. The method according to claim 16, characterized in that the reassuring of both position and orientation comprises:

providing a geodesic instrument with target-seeking function placed at a distance from the machine; and measuring against at least one target on the machine.

25. The method according to claim 24, further comprising providing direction-indication for the geodesic instrument as to an associated target towards which instantaneous target seeking is to be performed for measuring against the associated target.

26. The method according to claim 16, characterized by storing a map with desired topography of a region which is to be processed in a calculating device, calculating data for the working part of the tool and presentation thereof as position and angular positions relative to the map on a presentation unit.

27. The method according to claim 16, characterized in that the position and orientation determination is performed comprising a relatively slow determination in order to measure, at time intervals, at least one of the actual position of the machine and the orientation of the machine, and a relatively fast determination which reacts to at least one of position and orientation differences relative to earlier determination(s) in order to calculate and update the determination between the said time intervals.

28. The method according to claim 27, wherein the relatively fast determination comprises:

acceleration-measuring in at least one direction;

integrating the indicated acceleration(s); and updating the latest calculation result of at least one of the position and the orientation in the fixed coordinate system.

29. The method according to claim 27, characterized in that, at the relatively fast determination, at least one rotation-indication is performed for rotation around at least one axis of the machine.

* * * * *

UNITED STATES PATENT AND TRADEMARK OFFICE

CERTIFICATE OF CORRECTION

PATENT NO. : 7,003,386 B1 
APPLICATION NO. : 09/341101
DATED : February 21, 2006
INVENTOR(S) : Ericsson et al.

It is certified that error appears in the above-identified patent and that said Letters Patent is hereby corrected as shown below:

Col. 1, line 18 “place” should read --piece--;

Col. 3, line 6 “each” should read --even--;

Col. 3, line 14 “claims./ basic coordinate system” should read -- claim. (new paragraph) The technical field for the invention relates to a device and a method for determining the position of a working part of a tool of a working machine in a fixed ground-basic coordinate system;

Col. 4, line 42 “brought” should read --bought--;

Col. 5, line 58 “prism” should read --prisms--;

Col. 6, line 20 “difference” should read --different--;

Col. 6, line 26 “taken” should read --take--;

Col. 7, line 33 “is” should read --its--;

Col. 8, line 32 “I” should read --1--;

Col. 8, line 32 “e.g.,” should read --e.g.--;

Col. 10, line 34 “wireless” should read --wirelessly--;

Col. 10, line 50 “of scraper” should read --of a scraper--;

Col. 11, line 5 “scrape” should read --scraper--;

Col. 11, line 33 “performed” should read --perform--;

Col. 11, line 62 “on” should read --one--;

UNITED STATES PATENT AND TRADEMARK OFFICE

CERTIFICATE OF CORRECTION

PATENT NO. : 7,003,386 B1
APPLICATION NO. : 09/341101
DATED : February 21, 2006
INVENTOR(S) : Ericsson et al.

It is certified that error appears in the above-identified patent and that said Letters Patent is hereby corrected as shown below:

Col. 13, line 2 “totatably” should read --rotatably--;

Col. 13, line 33 “treated:” should read --treated;--; and

Col. 14, line 61 “reassuring” should read --measuring.

Signed and Sealed this

Eighth Day of August, 2006

JON W. DUDAS
*Director of the United States Patent and Trademark Office*